US010594032B2

(12) United States Patent
Rmili et al.

(10) Patent No.: US 10,594,032 B2
(45) Date of Patent: Mar. 17, 2020

(54) BEAM SCANNING ANTENNA AND METHOD OF BEAM SCANNING

(71) Applicant: King Abdulaziz University, Jeddah (SA)

(72) Inventors: Hatem Rmili, Jeddah (SA); Abdallah Dobaie, Jeddah (SA); Raj Mittra, Jeddah (SA)

(73) Assignee: King Abdulaziz University, Jeddah (SA)

( * ) Notice: Subject to any disclaimer, the term of this patent is extended or adjusted under 35 U.S.C. 154(b) by 22 days.

(21) Appl. No.: 16/002,494

(22) Filed: Jun. 7, 2018

(65) Prior Publication Data

US 2019/0379118 A1 Dec. 12, 2019

(51) Int. Cl.
*H01Q 3/32* (2006.01)
*H01Q 21/08* (2006.01)
*H01Q 21/06* (2006.01)

(52) U.S. Cl.
CPC ..... *H01Q 3/32* (2013.01); *H01Q 21/065* (2013.01); *H01Q 21/08* (2013.01)

(58) Field of Classification Search
CPC ..... H01Q 3/32; H01Q 21/06; H01Q 21/08; H01P 1/18
See application file for complete search history.

(56) References Cited

U.S. PATENT DOCUMENTS 6,483,393 B1 * 11/2002 How ..... H01P 1/19 333/219.2
7,034,748 B2 * 4/2006 Kajiya ..... H01P 1/181 333/161
10,403,974 B2 * 9/2019 Moon ..... H01P 1/184
2011/0187614 A1 8/2011 Kirino et al.

FOREIGN PATENT DOCUMENTS

WO 2008/081807 A1 7/2008
WO 2017/113147 A1 7/2017

* cited by examiner

*Primary Examiner* — Dameon E Levi
*Assistant Examiner* — Hasan Z Islam
(74) *Attorney, Agent, or Firm* — Oblon, McClelland, Maier & Neustadt, L.L.P.

(57) ABSTRACT

The present disclosure provides a low-cost beam scanning antenna and method of beam scanning in which two phase shifts are performed in an array of antenna elements. One of the phase shifts is performed in discrete stepwise increments in a feedline of the antenna element and another phase shift is performed by radiating a signal through variable phase shifters. The amount of phase shift provided by the variable phase shifters is varied by changing a rotation angle of the variable phase shifters.

8 Claims, 18 Drawing Sheets

TRIMETRIC VIEW

BEAM SCANNING ANTENNA AND METHOD OF BEAM SCANNING

BACKGROUND

Field of Disclosure

The present disclosure relates generally to a phase shifter for beam scanning antennas where, for example, split-rings as the phase shifting element are formed in a single-layer cluster and rotated and to a method of beam scanning utilizing a two-step phase shifting approach.

Description of the Related Art

Phased Array antennas are widely used for beam scanning applications in communication systems. Phased array antennas include phase shifters for altering the phase of a wave to be transmitted, thus steering the beam of radio waves or the like in different directions. Phase shifters are used to change the transmission phase angle (phase of $S_{21}$) of a two port network. In phased array antenna systems, the phases of a large number of antenna elements are controlled to force the electromagnetic wave to add up at a particular angle to the array. The total phase variation of a phase shifter typically is 360 degrees to control an Electronically Steerable Array of moderate bandwidth. It is well known that phase shifters utilized in these applications have problems including that they are lossy, bulky and costly.

Extensive research has been carried out in recent years for designing phased array antennas, especially in the context of satellite communication applications, and the design of civilian radar-based sensors. A number of different approaches have been proposed for scanning the beams of phased array antennas for these applications. Most of these approaches call for biasing configurations that are needed, either for activating certain switches, e.g., pin diodes or varactor diodes (see G. PEREZ-PALOMINO, J. A. ENCINAR, M. BARBA, AND E. CARRASCO, "Design and evaluation of multi-resonant unit cells based on liquid crystals for reconfigurable reflectarray," in *Inst. Elect. Eng. Proc.* Microwaves Antennas Propagation, 2012, vol. 6, no. 3, pp. 348-354), or for modifying the electrical properties of materials (see TEO, P. T.; JOSE, K. A.; GAN, Y. B.; VARADAN, V. K.: 'Beam scanning of array using ferroelectric phase shifters', *Electronics Letters,* 2000, 36, (19), p. 1624-1626), in order to realize the desired phase-shift when integrated with the antenna elements of the array. FIGS. 1A and 1B show some typical examples of such devices that are commonly used for beam scanning. FIG. 1A shows an example switch-based phase shifting configuration, e.g., MEMS switches. FIG. 1B shows a liquid crystal-based phase shifting configuration. The liquid crystal layer lies between a superstrate and a substrate, which are separated by spacers. The phase shifter may be associated with a patch antenna, where the patch antenna has a feed line and a bias line. Phase shifters introduce step-wise phase shifts in the fields radiated by the antenna elements to realize beam scanning by the array.

A design for a reflection type phase shifter of low loss and a large phase-shifting variation has been realized by inputting a high-frequency signal from a radiator to the inside of a two-dimensional waveguide using a conductor plate. In the phase shifter and the antenna, a moving mechanism translates the conductor plate while maintaining a certain distance by fixing every time separation and separation from another conductor plate. A moving mechanism based on translation is difficult to implement in two-dimensional arrays, because it requires larger separation distances between the antenna elements, and hence it is seldom used in practice.

The foregoing "Background" description is for the purpose of generally presenting the context of the disclosure. Work of the inventors, to the extent it is described in this background section, as well as aspects of the description which may not otherwise qualify as prior art at the time of filing, are neither expressly or impliedly admitted as prior art against the present invention.

SUMMARY OF THE INVENTION

A first aspect of the present disclosure provides A beam scanning antenna, including: at least one linear array element, each linear array element having at least one patch antenna, each patch antenna including a feed line, an radiating element configured to radiate a signal from the feed line, a phase shifting device configured to provide a first phase shift in the feed line, and a precision rotary device; and at least one metasurface-based superstrate positioned above the respective patch antenna and configured to introduce a second phase shift in the signal traversing through it; wherein the second phase shift varies due to rotation of the at least one metasurface-based superstrate by the precision rotary device.

A second aspect of the present disclosure provides a method for beam scanning by a beam scanning antenna, the beam scanning antenna including a plurality of phase shifting devices included in a feed line of an antenna and variable phase shifters mounted on a patch antenna, the method including steps of: scanning, in stepwise increments of a first phase shift, via the phase shifting devices; and fine tuning the phase of the field radiated by the patch antenna by a second phase shift via variable phase shifters.

The above aspects allow for the production and use of an improved beam scanning antenna and a method for beam scanning that can reduce costs by reducing the number of expensive components needed for phase shifting a signal radiated by the antenna.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1A:
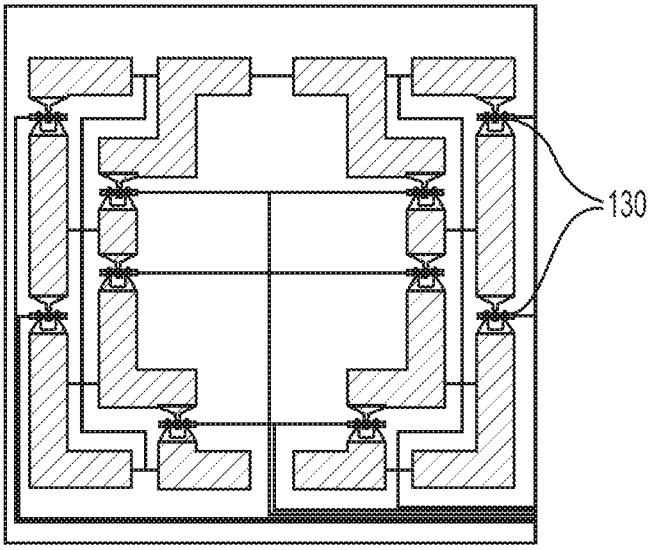
FIG. 1A shows a top view of a liquid crystal-based example of a phase-shifting configuration.
Figure 1B:
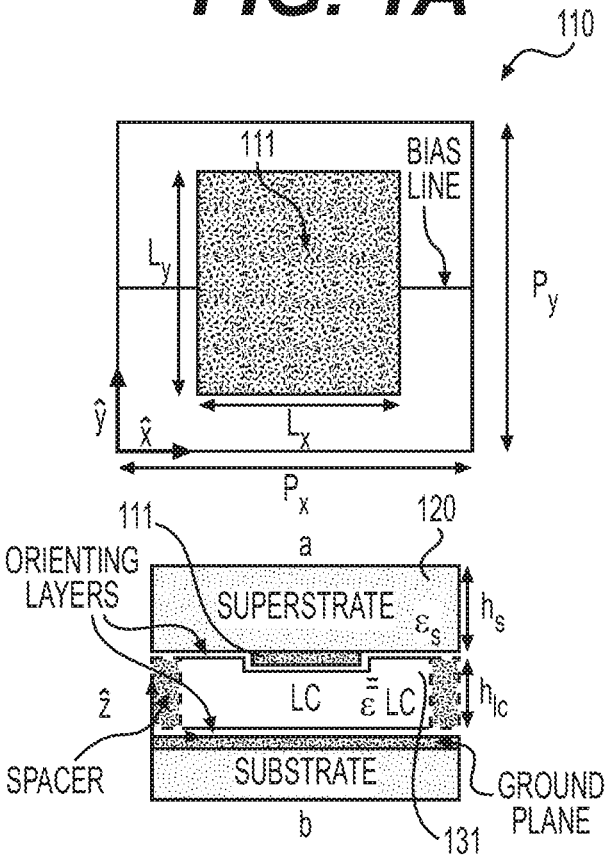
FIG. 1B shows a side view of a liquid crystal-based example of a phase-shifting configuration.

Referring now to the drawings, wherein like reference numerals designate identical or corresponding parts throughout several views, the following description relates to a low cost, low loss variable phase shifter, and in particular a phased array antenna including the variable phase shifting device.

First Exemplary Embodiment

Disclosed are low-cost, variable phase shifters for the antenna elements 100 of a phased array. In a first exemplary embodiment, a desired phase shift in an antenna array is realized by using a combination of two stages. In the first of these stages, discrete stepwise increments of $\theta_x$ phase shifts are realized by inserting switches 130, liquid crystal layers 131, or other phase shifting devices in the feed line 113 such that the phase of a signal carried therein is shifted prior to reaching the radiating element 111, as opposed to performing a phase shift at the radiating element of the antenna. In this exemplary embodiment, $\theta_x$ is 45°, meaning that the discrete stepwise increments may be, for example, 0°, 45°, 90°, 135°, and so on. Next, a fine tuning of the phase of the field radiated by the radiating element 111 is carried out by using variable phase shifters 123 in the range of, for example, 0° to $\theta_x$, by implementing them in the antenna elements 100, using a technique described below. Here, the range of the variable phase shifters 123 is equal to the range between the discrete stepwise increments of the phase shift devices in the feed line 113, and by combining the stepwise phase shifts in the feed lines 113 with the variable ones above the patch antenna 110, a continuously varying phase shift in the range of 0° to 360° can be realized in the field radiated by each radiating element 111.

In this embodiment, a variable phase shifter is disclosed, having a phase range of, for example, 0° to 45°, which is based on the use of metasurface-based superstrates 120, and which preferably are a truncated periodic structure. The metasurface-based superstrate 120 is placed above the radiating element 111 to introduce a phase shift in the wave traversing through it and the amount of the phase shift is varied by rotating the metasurface-based superstrate 120 via a precision rotary device 125 such as a stepper motor or the like.

Figure 13:
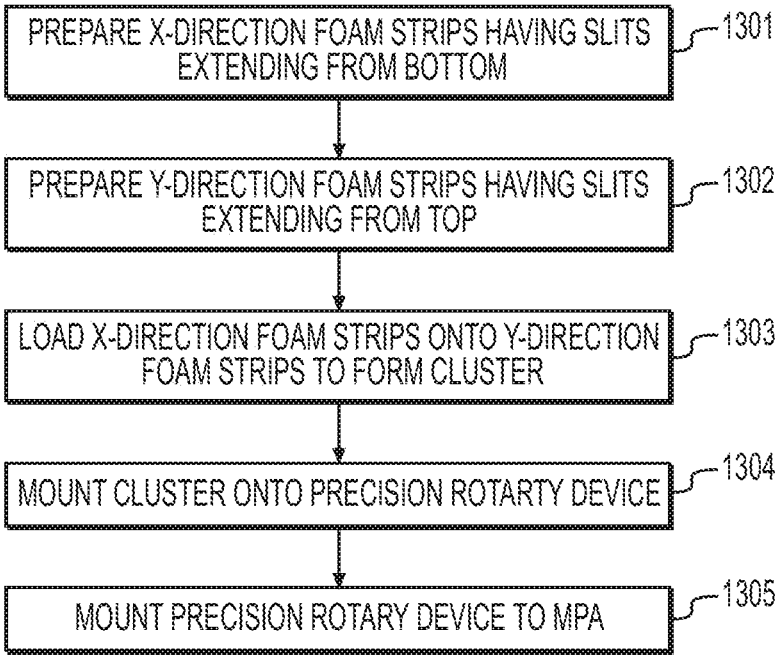
FIG. 13 is a flowchart for a method of producing a phase shifting metasurface-based superstrate mounted on a microstrip patch antenna, according to an exemplary aspect of the disclosure.
Figure 14:
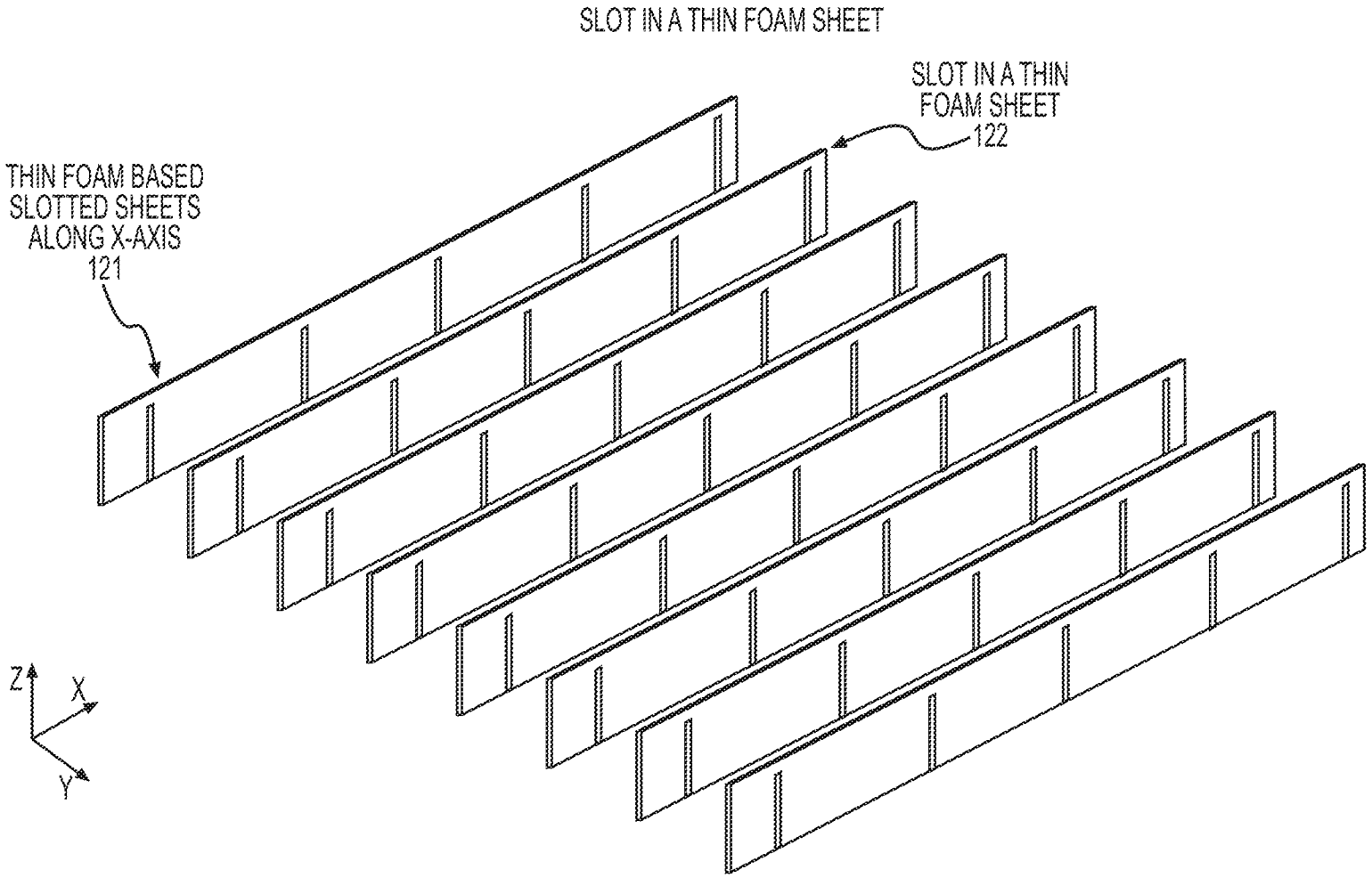
FIG. 14 is a schematic illustrating a phase-shifter holder, according to an exemplary aspect of the disclosure.
Figure 15:
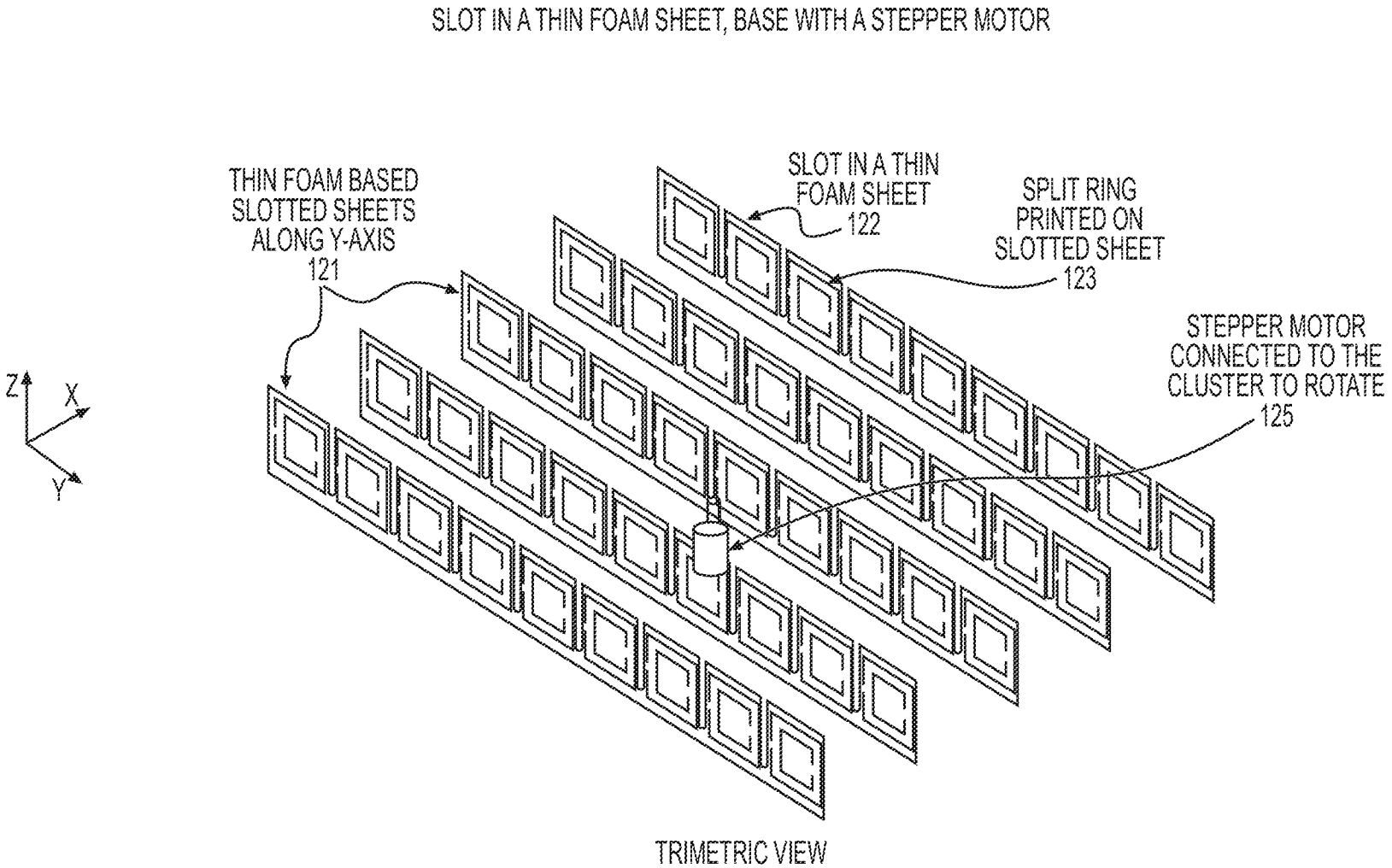
FIG. 15 is a schematic illustrating a phase-shifter, according to an exemplary aspect of the disclosure.

An approach to assembling a variable phase shifter of the disclosure is hereafter described in terms of a production method. FIG. 13 is a flowchart for a method of producing a variable phase shifter mounted above a microstrip patch antenna (also referred to simply as "patch antenna" or "MPA") 110, according to an exemplary aspect of the disclosure. In S1301, strips, for example, made of foam having slits extending from one lengthwise edge are provided for arrangement in an X-axis direction. FIG. 14 shows eight foam based rectangular strips 121 having slots extending from the bottom. The foam strips 121 hold the phase-shifters 123 which are printed thereon. In S1302, another set of foam strips 121 are provided for arrangement in a Y-axis direction. FIG. 15 shows five foam strips 121 having slots cut from the top of each foam strip 121. Each foam strip 121 has nested split-rings printed on squares of the foam strip 121. In an exemplary aspect, rectangular strips having nested split-rings may be cut to form the individual strips. In an exemplary aspect, once the strips having the arrays of nested split rings are formed as per the needed cluster, the slot is cut from the top of each strip as shown in FIG. 15.

Figure 16:
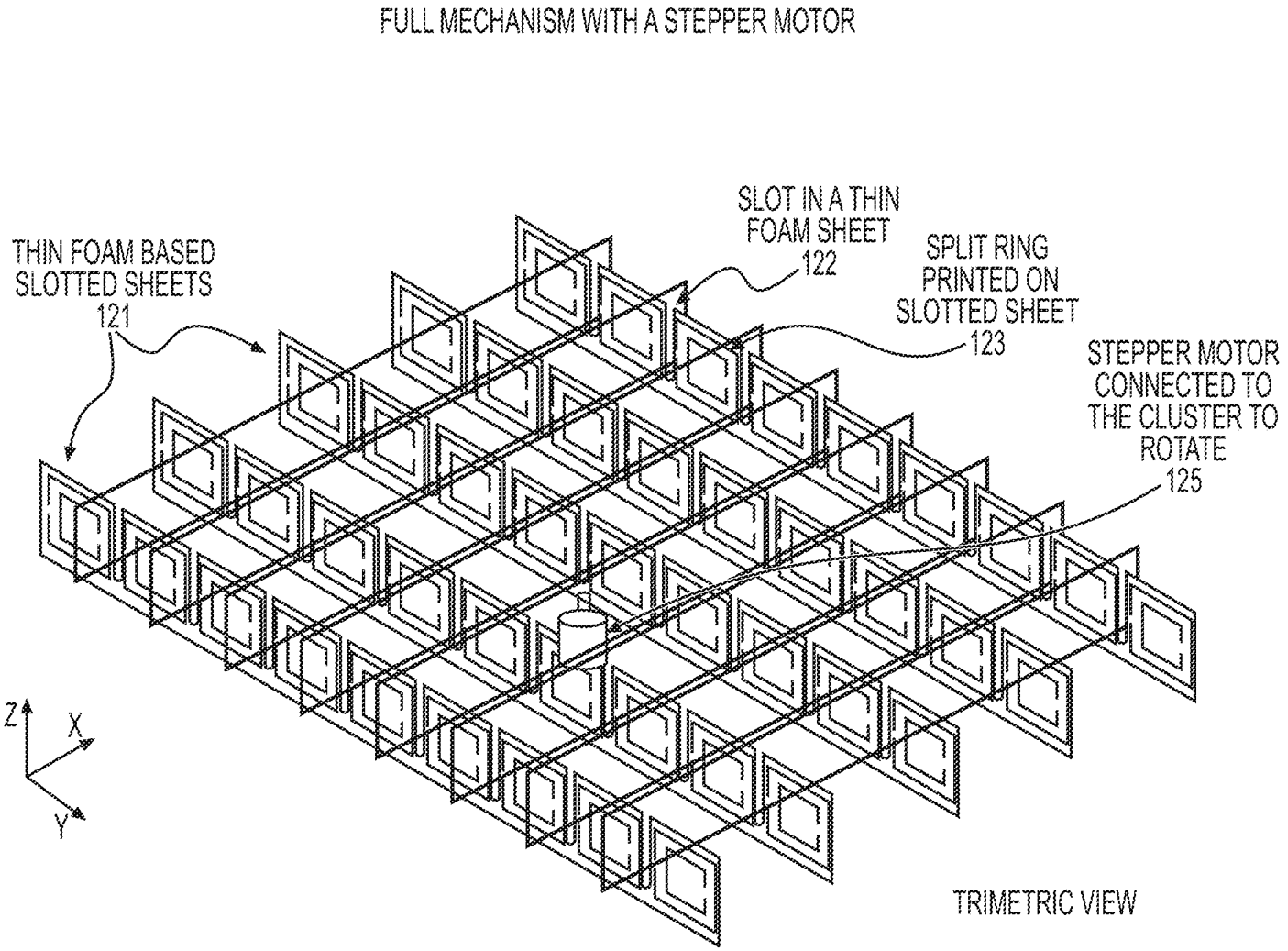
FIG. 16 is a schematic illustrating a phase-shifter cluster printed on foam sheet, according to an exemplary aspect of the disclosure.

Next, in S1303, the rectangular foam strips 121 (as shown in FIG. 14) are loaded from the top on rectangular strips having arrays of nested split-rings (as shown in FIG. 15). The completed cluster is shown in FIG. 16.

Figure 17:
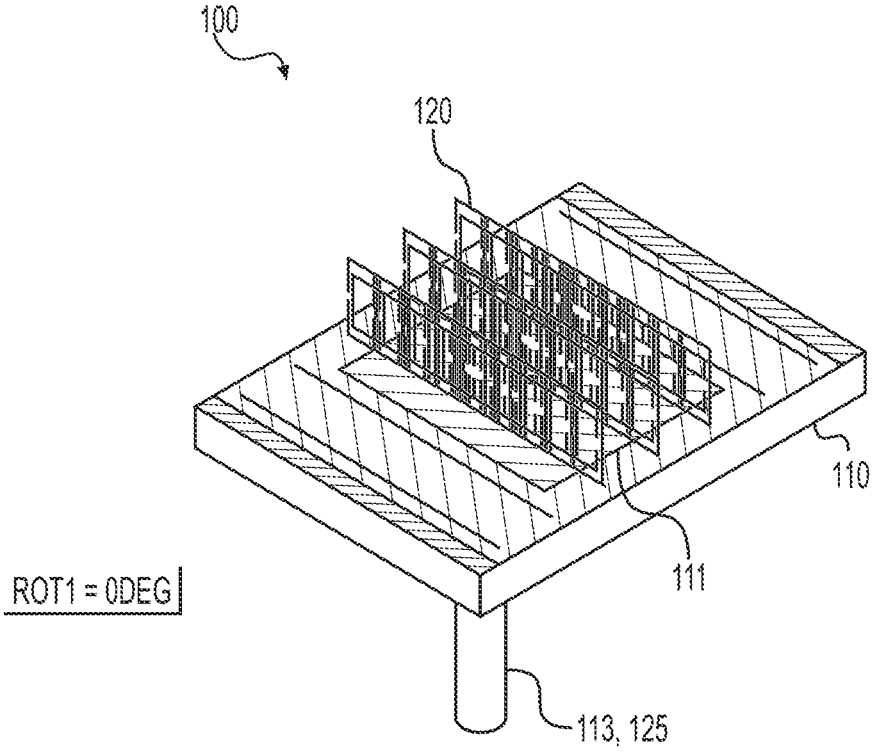
FIG. 17 is a prospective view illustrating a phase-shifter (cluster of split-rings) loaded on an MPA, according to an exemplary aspect of the disclosure.

Once the cluster is complete, in S1304, a precision rotary device 125 may be used to hold the entire cluster. In operation, the precision rotary device 125 rotates the cluster step-wise. The nested split-rings formed in the cluster (single-layer) as in FIG. 16 may be rotated to achieve the desired phase-shift in range of 0° to 49°, preferably 0° to 45°. In S1305, the cluster and precision rotary device 125 are mounted to a microstrip patch antenna 110. FIG. 17 shows the phase-shifter (single layer) loaded on the microstrip patch antenna 110. A higher range of phase-shift may be made by including an additional layer (second layer) of the cluster of nested split-rings on top of the first layer.

Figure 7A:
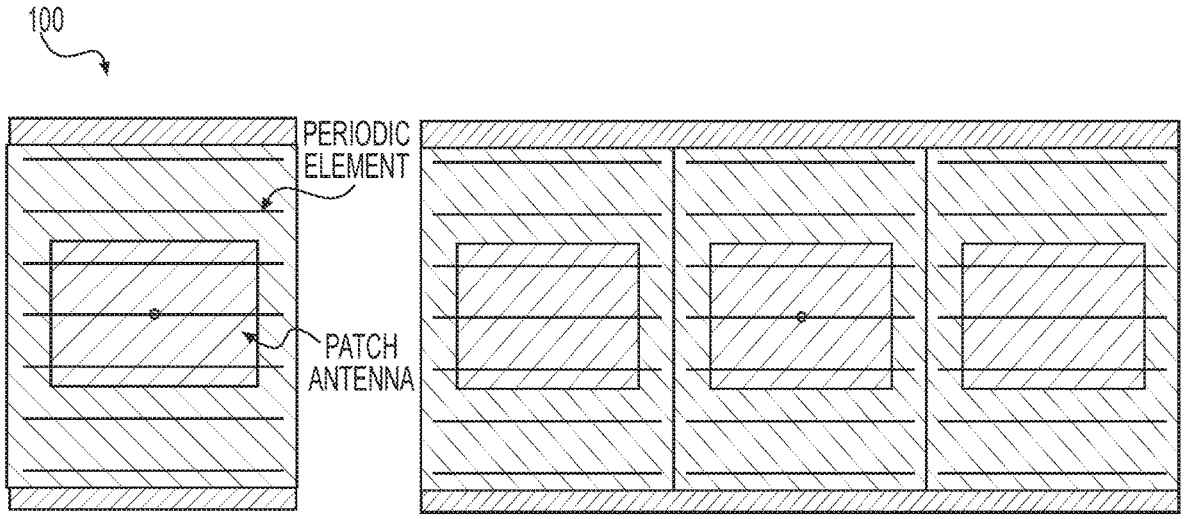
FIG. 7A is a schematic illustrating a metasurface based superstrate loaded on a MPA rectangular source according to an exemplary aspect of the disclosure.
Figure 7B:
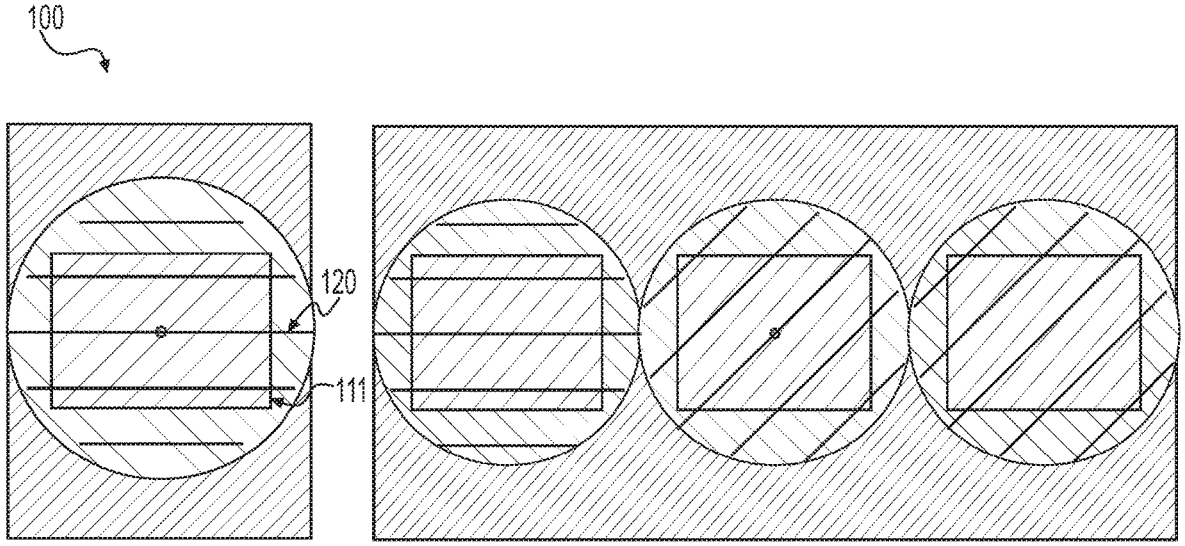
FIG. 7B is a schematic illustrating a metasurface based superstrate loaded on a plurality of MPA rectangular sources according to an exemplary aspect of the disclosure.

In selecting the shape of the metasurface-based superstrate 120, a logical choice may appear to be that of a rectangle matching the shape of a typical MPA 110; however, unless the MPAs 110 are disposed at a sufficient distance from each other, a rectangular shaped superstrate 120 above the MPAs 110 would cause the element-plus-superstrate combination of the neighboring elements to clash if the metasurface-based superstrate 120 were to be rotated, as is apparent in FIGS. 7A, 7B illustrating a metasurface-based superstrate 120 loaded on the MPA 110 source (7A) rectangular, (7B) circular, according to an exemplary aspect of the disclosure. To circumvent the problem of obstruction of the neighboring elements in the design of the linear array, a circular arrangement of periodic elements, as shown in FIG. 7B, is preferably implemented. Such arrangement allows the fixed-positioned MPAs 110 to be arranged closer together than would be possible with a rectangular contour of the metasurface-based superstrate 120.

A system which includes the features in the foregoing description provides numerous advantages. In particular, a system having the phase-shifter mounted on a microstrip patch antenna 110 can be fabricated by using printed circuit technology in a cost-effective manner.

Second Exemplary Embodiment

Figure 18:
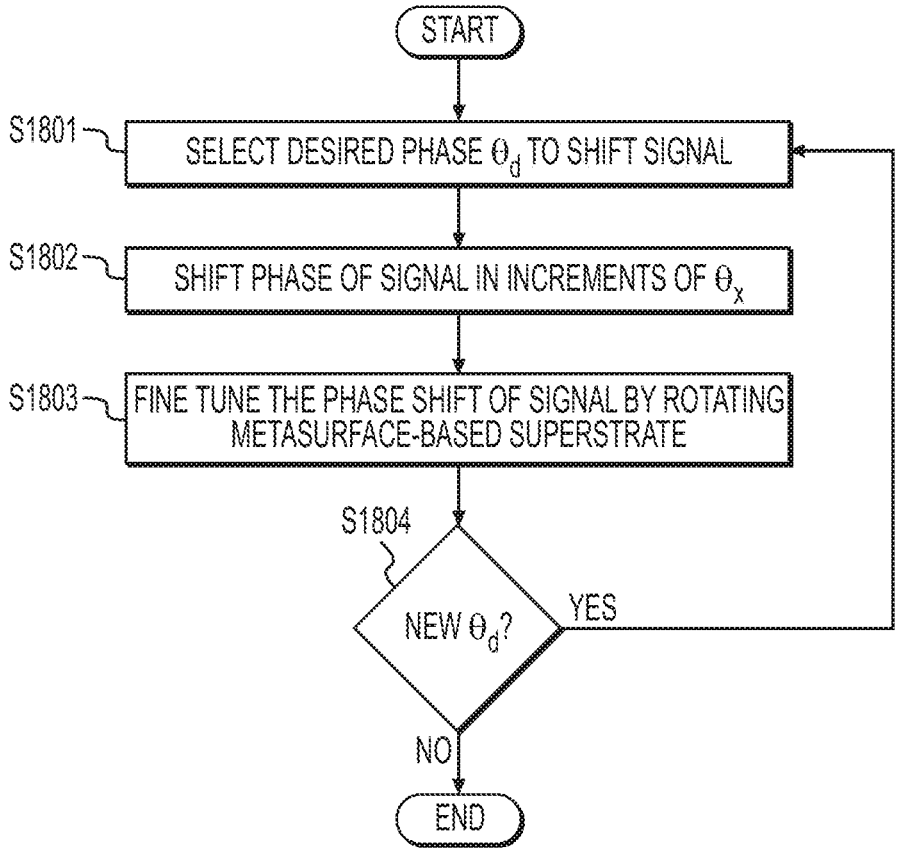
FIG. 18 shows a flow chart including fine tuning a phase shift.

In a second exemplary embodiment, a method of beam scanning is provided which will be described with reference to FIG. 18.

In this embodiment, beam scanning is performed using a beam scanning antenna including a plurality of phase shifting devices included in the feed lines of the patch antennas 110 and variable phase shifters 123 (of a rotatable metasurface-based superstrate 120) mounted above respective patch antennas 110 of the beam scanning antenna. First, in step S1801, a desired phase shift $\theta_d$ to be applied to a signal to be emitted from the beam scanning antenna is determined.

In step S1802, by way of the phase shifting devices of the feed lines, the phase of the source signal is shifted in stepwise increments of $\theta_x$ such that the phase $\theta$ of the signal meets the expression: $\theta_d-\theta<\theta_x$ For example, in the case that the phase shifting devices shift in stepwise increments of $\theta_x$=45° and the desired phase shift $\theta_d$ is 140°, the signal is shifted in the feed line by 135°.

Next, in step S1803, the signal radiated from the patch antenna 110 is shifted as the signal passes through the variable phase shifters 123. Therefore, the amount of the phase shift is tuned by rotating the variable phase shifters 123 above the patch antennas 110 such that the phase of the wave becomes the desired phase $\theta_d$ Using the same example above, where $\theta_x$ is 45° and $\theta_d$ is 140°, the variable phase shifters 123 would be rotated to an angle at which the phase is shifted 5° in order to reach the desired phase shift of 140°.

The process of scanning new beam angles repeats indefinitely from step S1804 as necessary.

Experimental Results

Figure 2A:
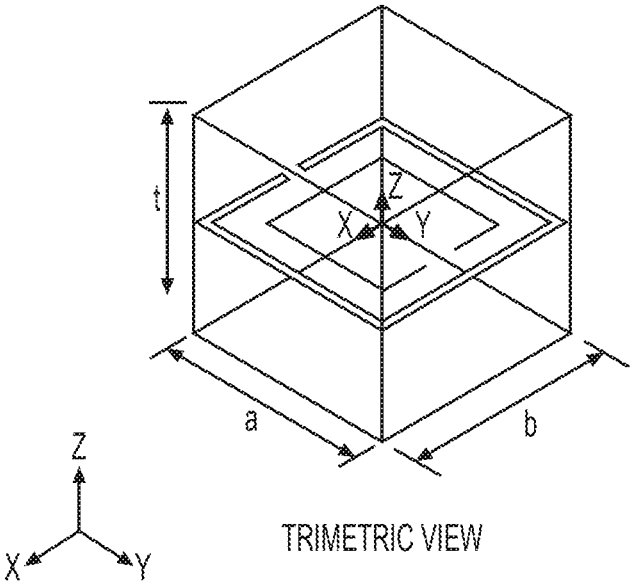
FIG. 2A is a schematic diagram illustrating a unit-cell of metasurface-based phase shifter including a trimetric view, according to an exemplary aspect of the disclosure.
Figure 2B:
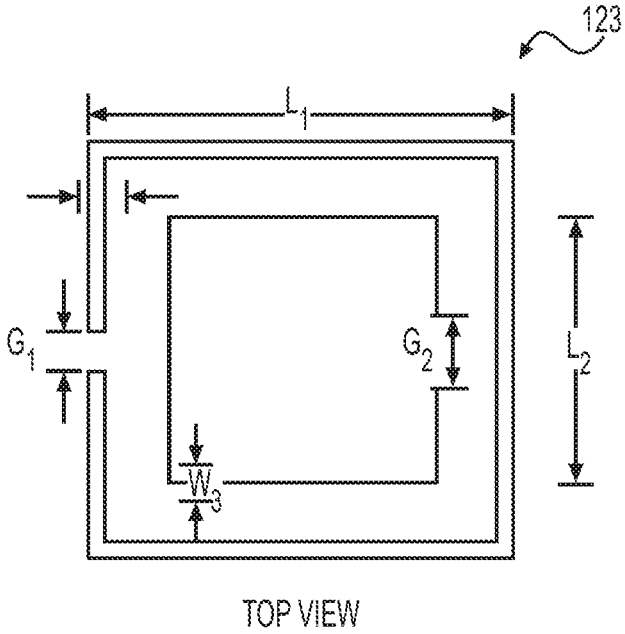
FIG. 2B is a schematic diagram illustrating a unit-cell of metasurface-based Phase shifter including a top view, according to an exemplary aspect of the disclosure.

In order to provide insight into the methodology of design and the operation of a working example of the present disclosure, a simulation was performed and will be described here with reference to figures. The first step in the design of low-cost variable phase shifters 123 was to realize up to a maximum phase shift of $S_{21}$ on the order of 45°, at the center frequency f=30 GHz. FIGS. 2A, 2B are schematic diagrams illustrating a unit-cell of metasurface-based phase shifter. FIG. 2A shows a trimetric view; FIG. 2B shows a top view. FIGS. 2A, 2B show an example of a unit cell of a metasurface-based superstrate 120 that is illuminated by a plane wave.

Initially, a goal was to set the magnitude of $S_{21}$ to be 0.5 dB, in order to ensure that the introduction of the metasurface-based superstrate 120 above the radiating element 111 would not compromise the gain of the element by more than the insertion loss of 0.5 dB. However, it was later discovered that such a restriction on the magnitude of $S_{21}$ is unnecessary, since there is no clear and/or direct relationship between the insertion loss values of the metasurface-based superstrate 120 derived by illuminating it by a plane wave source, and by a radiating element 111 radiating from below the metasurface-based superstrate 120. In fact, it was found that the plane-wave insertion loss of the superstrate unit cell may even translate into relative gain when the metasurface-based superstrate 120 is incorporated in the antenna element 100, because the physics of the radiation mechanism are very different in the two cases. For this reason, the restriction on the insertion loss of $S_{21}$ for the plane wave case was removed, and in this example simulation only the gain performance of the radiating element 111 in the presence of the metasurface-based superstrate 120 is considered. Subsequently, in the design process the phase shift realized by the introduction of the metasurface-based superstrate 120 was determined independently for the antenna case. As such, the $S_{21}$ of the plane wave case is used as a guideline.

Next, a simulation of the unit cell is performed by using a plane-wave source placed below the metasurface-based superstrate 120, in Port-1, along with the periodic boundary conditions in the EM simulator HFSS. The periodicities 'a' & 'b' of the unit cell (see FIG. 2A) are chosen to be equal, and on the order of $\lambda/10$, far away from the resonance of the structure including the unit cell, in order to ensure that the design would be relatively wideband.

Figures 3A, 3B, 3C:
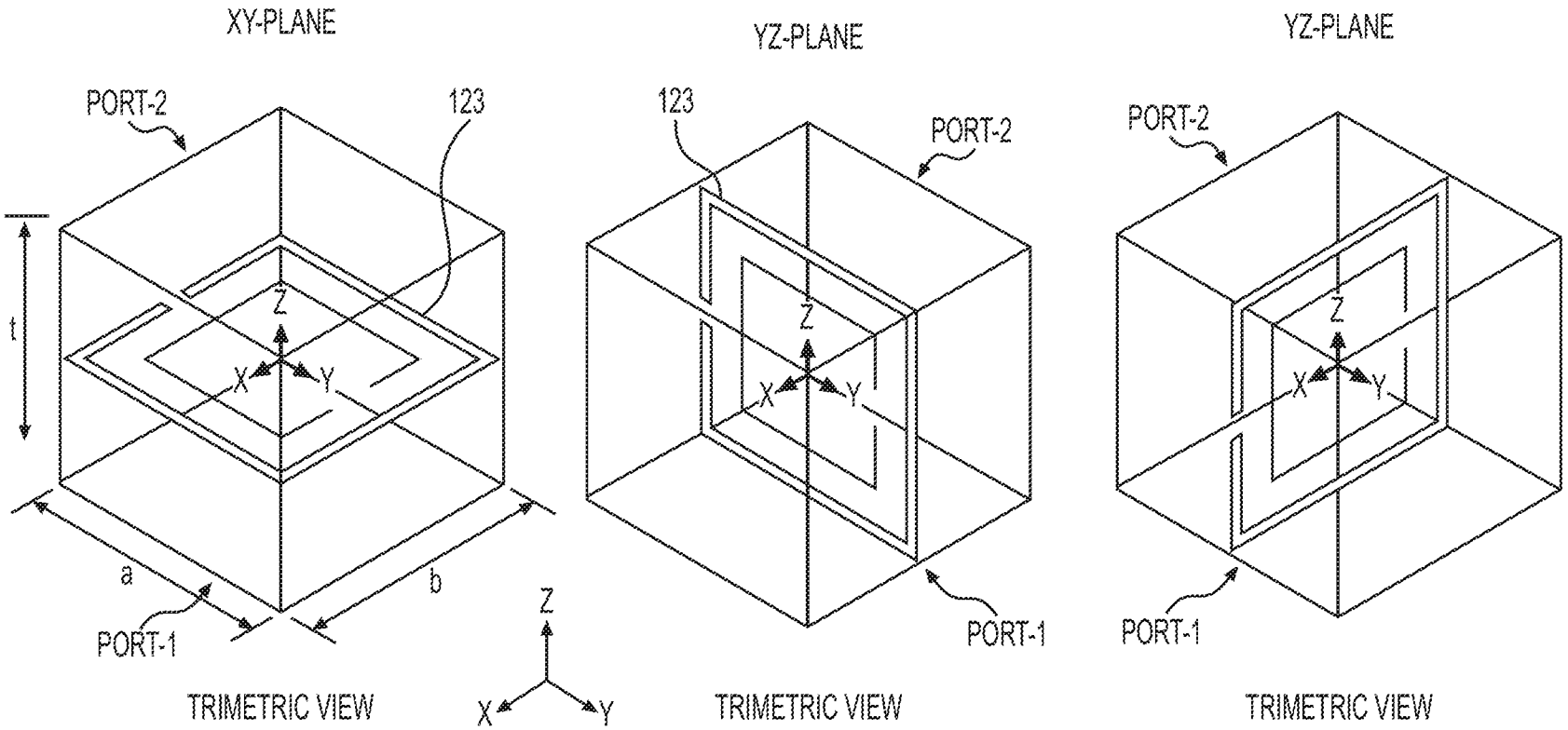
FIG. 3A is a xy-plane schematic illustrating a unit cell of the superstrate comprising of nested square split rings according to an exemplary aspect of the disclosure.
FIG. 3B is a yz-plane schematic illustrating a unit cell of the superstrate comprising of nested square split rings according to an exemplary aspect of the disclosure.
FIG. 3C is a xz-plane schematic illustrating a unit cell of the superstrate comprising of nested square split rings according to an exemplary aspect of the disclosure.
Figure 4A:
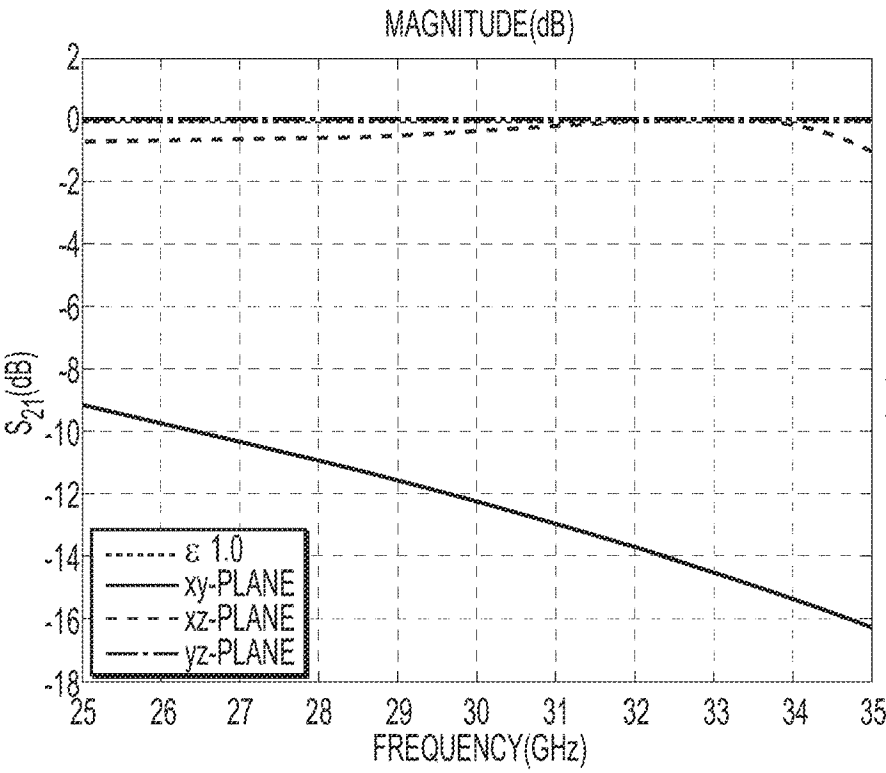
FIG. 4A is a graph illustrating performance characteristics of the superstrate unit cell: $S_{21}$ magnitude, according to an exemplary aspect of the disclosure.
Figure 4B:
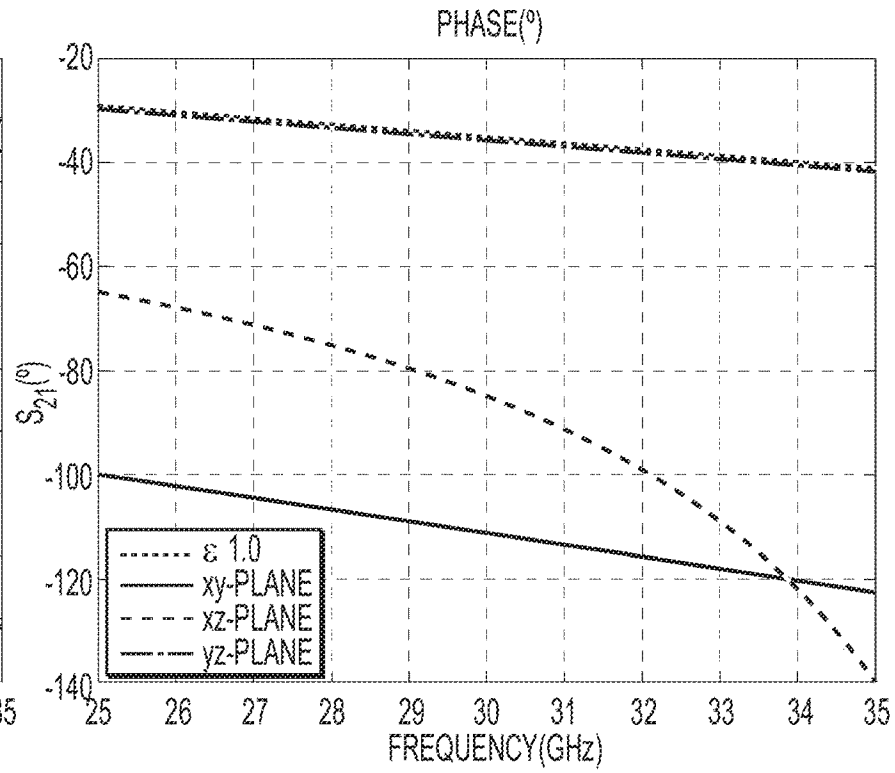
FIG. 4B is a graph illustrating performance characteristics of the superstrate unit cell: $S_{21}$ Phase, according to an exemplary aspect of the disclosure.

Next, the parameters of the metasurface-based truncated periodic structure, having nested square split rings, is optimized with the goal of achieving an $S_{21}$ phase shift of 45°. FIG. 3 is a schematic illustrating a unit cell of the metasurface-based superstrate 120 having nested square split rings: (a) xy-plane, (b) yz-plane, and (c) xz-plane, according to an exemplary aspect of the disclosure. The periodic structure is oriented along different planes, namely x-y, y-z and x-z, as shown in FIG. 3, and the magnitude is measured as well as phase of $S_{21}$ in the output port above the unit cell, i.e., in Port-2. The parameters of the element simulated are listed in Table 1. FIG. 4 shows graphs that illustrate performance characteristics of the superstrate unit cell: (a) $S_{21}$ Magnitude, (b) $S_{21}$ Phase, according to an exemplary aspect of the disclosure FIG. 4 shows the $S_{21}$ behavior of the of the unit cell of the metasurface-based superstrate 120.

TABLE 1

Dimensions of metasurface-based phase-shifting element.

| $L_1$ (mm) | $L_2$ (mm) | $W_1$ (mm) | $W_2$ (mm) | $G_1$ (mm) | $G_2$ (mm) |
|---|---|---|---|---|---|
| 0.98 | 0.63 | 0.03 | 0.08 | 0.09 | 0.16 |

FIG. 4 shows that when the $E_x$-field of an incident plane wave is parallel to the periodic structure (see x-z in FIG. 3(*c*)), and the $H_y$-field is orthogonal to the loop, a differential phase shift of 48.9° (difference in phase between x-z curve and ϵ curve at 30 GHz) is achieved for the $S_{21}$, with a magnitude of −0.38 dB (x-z curve at 30 GHz), at the design frequency f=30 GHz. Similarly, when the $E_x$-field of an incident plane wave is normal to the periodic structure (see y-z in FIG. 3 (*b*)), the differential phase shift is 0° (difference in phase between y-z curve and ϵ curve at 30 GHz) and the $S_{21}$ magnitude is 0 dB (y-z curve at 30 GHz).

In contrast to these, a differential phase shift of 75.6° (difference in phase between x-y curve and ϵ curve at 30 GHz) is realized when the incident plane wave on the periodic structure shown in (a) of FIG. 3 is ex-polarized, which is considerably higher than what had been achieved for the ex-polarized field. However, as shown in FIG. 4, the $S_{21}$ magnitude for this case is −12.23 dB (x-y curve at 30 GHz), which is much higher than what is desired, even though the insertion loss criterion of 0.5 dB may be relaxed somewhat, that was set initially.

It is evident from FIG. 4 that the objective of designing a low-cost variable phase shifter in the range of 0° to 45°, with a relatively low insertion loss, can be achieved by using the arrangement in FIG. 5.

Figure 5A:
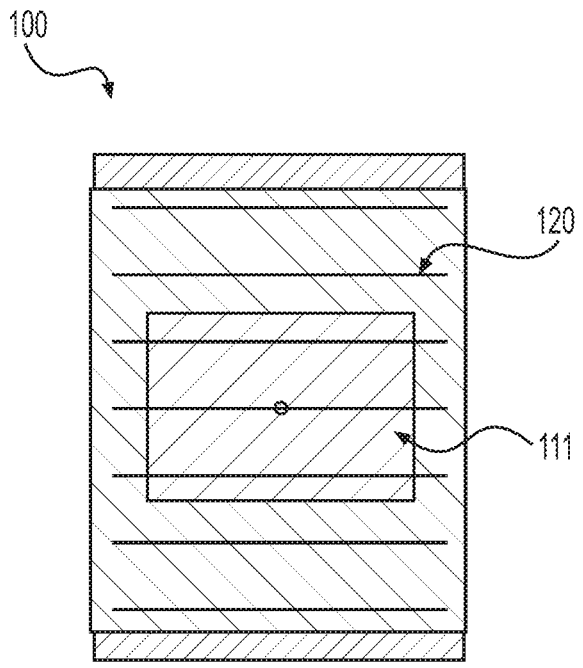
FIG. 5A is a top view schematic diagram illustrating a metasurface-based superstrate with a rectangular shape loading an MPA source located below according to an exemplary aspect of the disclosure.
Figure 5B:
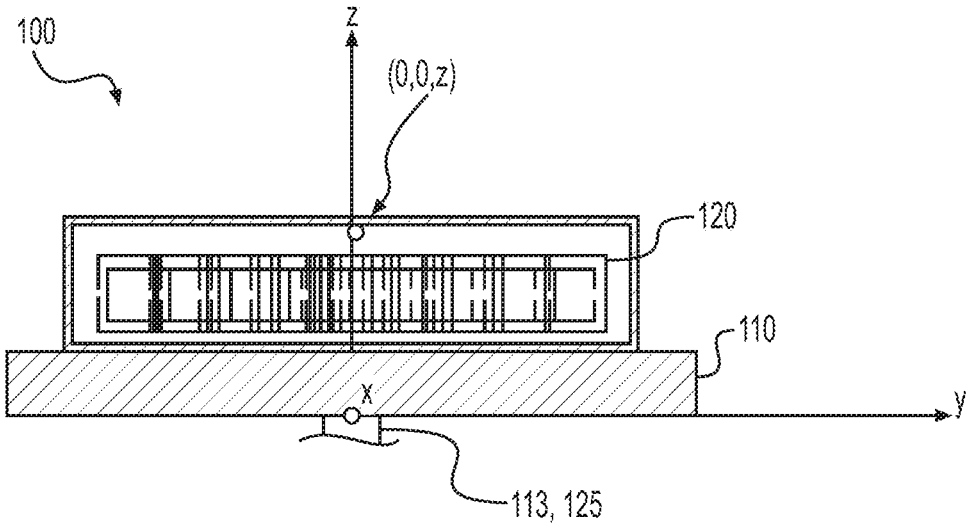
FIG. 5B is a side-view schematic diagram illustrating a metasurface-based superstrate with a rectangular shape loading an MPA source located below according to an exemplary aspect of the disclosure.

FIGS. 5A, 5B are a schematic diagram illustrating a metasurface-based superstrate 120 with a rectangular contour loading an MPA 110 source located below. FIG. 5A shows a top view, and FIG. 5B shows a side-view, according to an exemplary aspect of the disclosure. Variable phase shifts can be obtained ranging from 0° to 45° by systematically rotating the superstrate (truncated periodic structure) 120 placed atop the radiating element 111, and thus varying its orientation from the y-z plane ((b) in FIG. 3) to the x-z plane ((c) in FIG. 3).

Figure 6A:
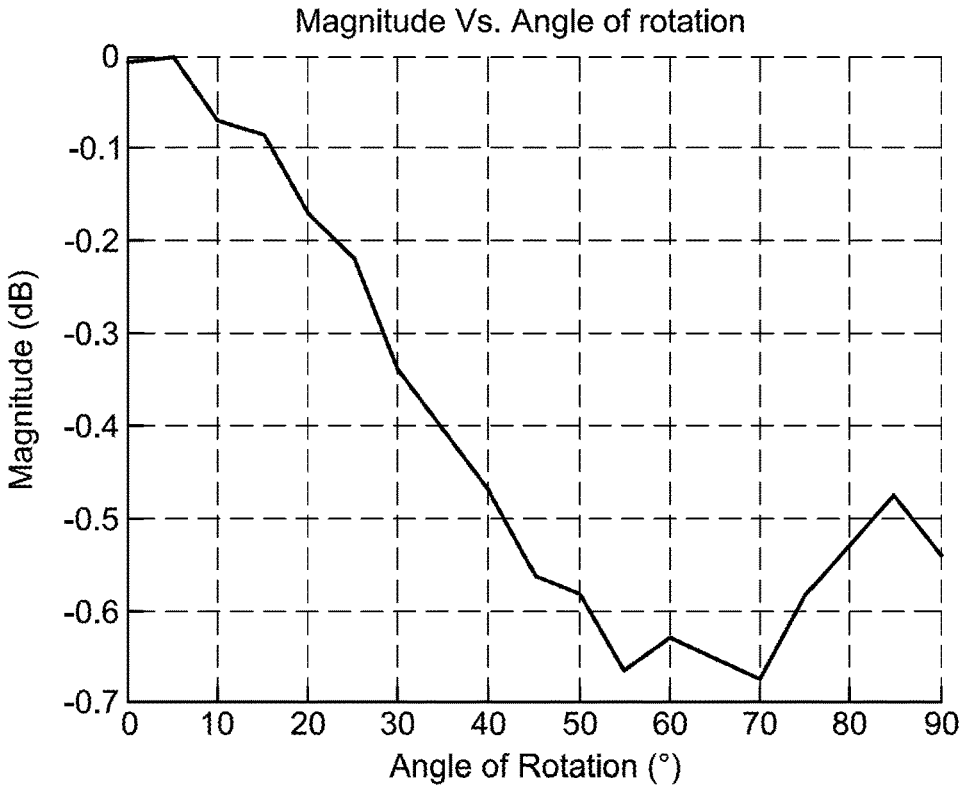
FIG. 6A is a graph illustrating a metasurface based superstrate loaded on MPA source With $S_{21}$ magnitude according to an exemplary aspect of the disclosure.
Figure 6B:
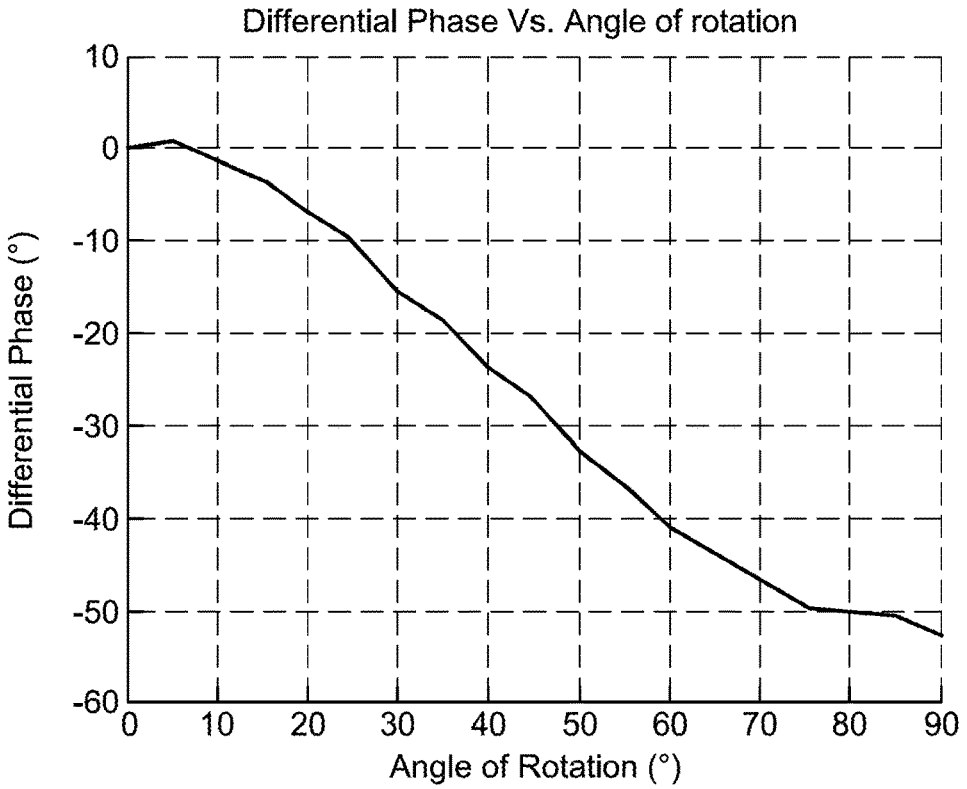
FIG. 6B is a graph illustrating a metasurface based superstrate loaded on MPA source with (b) $S_{21}$ Phase according to an exemplary aspect of the disclosure.

Next, the performance of the metasurface-based superstrate 120 when placed above a microstrip patch antenna (MPA) 110, is evaluated to determine its magnitude and phase behavior in the presence of the radiating element 111 underneath. The process begins by designing an MPA 110 at the operating frequency f=30 GHz, by utilizing the closed-form expressions available in the literature for designing MPAs (see R. GARG, P. BHARTIA, I. BAHL, & A. ITTIPIBOON, *Microstrip Antenna Design Handbook*, Artech, J. A. House, Boston, London, 2001). FIG. 5B shows how to place the metasurface-based superstrate 120, which is comprised of a cluster of 7×5 elements of nested split rings, so that it can be rotated from 0° to 90°. The performance results of the arrangement shown in FIGS. 5A, 5B are shown in FIG. 6 containing graphs illustrating the $S_{21}$ magnitude and $S_{21}$ differential phase of a metasurface-based superstrate 120 loaded on an MPA 110 source.

Figure 8A:
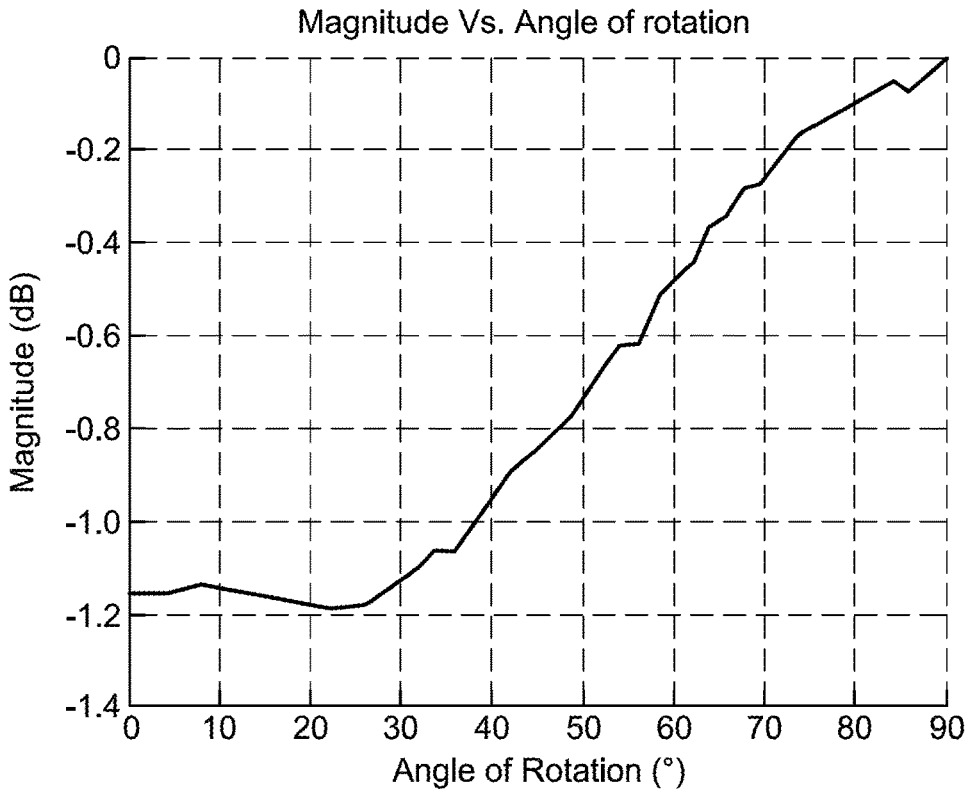
FIG. 8A is a schematic illustrating a metasurface based superstrate loaded on a MPA circular source according to an exemplary aspect of the disclosure.
Figure 8B:
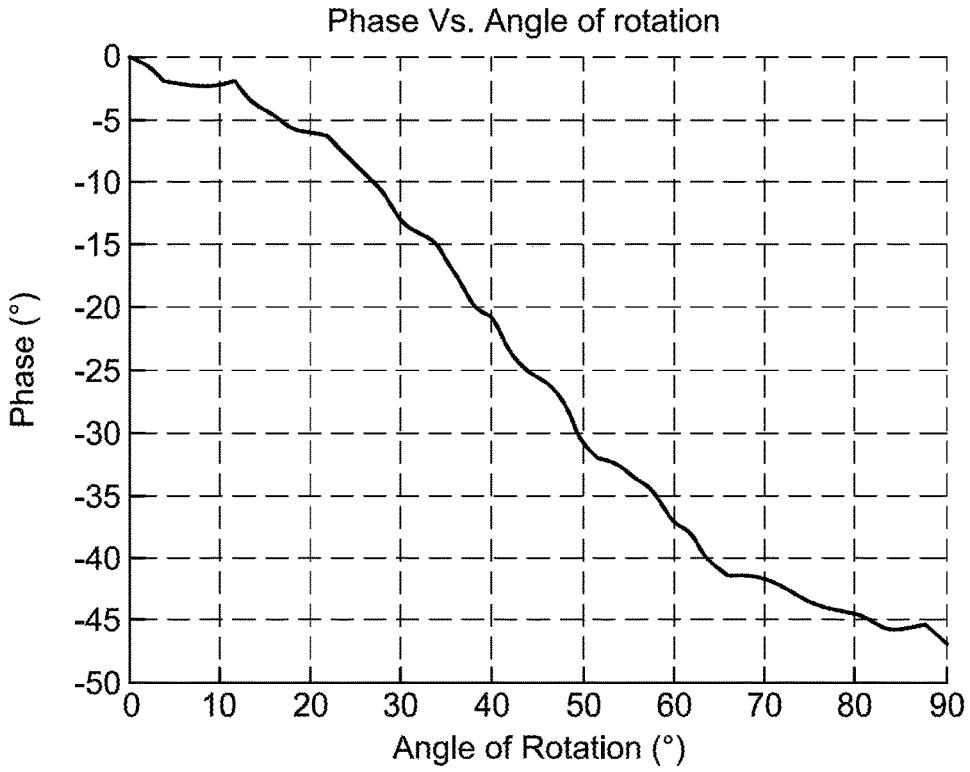
FIG. 8B is a schematic illustrating a plurality of metasurface based superstrates loaded on a plurality of MPA circular source according to an exemplary aspect of the disclosure.

FIG. 8 are graphs illustrating the $S_{21}$ magnitude and $S_{21}$ phase of a metasurface-based superstrate 120 of circular shape loaded on an MPA 110 source, according to an exemplary aspect of the disclosure. As can be seen in FIG. 8, a differential phase shift of 47° with an $S_{21}$ magnitude better than −1.2 dB, which was measured atop of the metasurface-based superstrate 120 at (0, 0, 2 mm) as shown on FIG. 5, can been achieved at the design frequency f=30 GHz by rotating the angle of the metasurface-based superstrate 120 from 0° to 90°. From these results shown in FIG. 8, $S_{21}$ magnitude and phase versus the angle of rotation (T) may be used to determine the needed values of the angle of rotation (T) to fine tune the phase of a signal radiated through a metasurface-based superstrate 120 having the properties of the superstrate used for the simulation.

By comparing the performances of the metasurface-based superstrate 120 operating in the two scenarios, namely the plane-wave and antenna cases, it can be seen that in general there is no clear relationship that can be used to predict the magnitude and phase behaviors of the radiation characteristics of a patch antenna 110 loaded with the metasurface-based phase shifter from the knowledge of its response to a plane wave. Thus, as pointed out earlier, the plane-wave results should be used to develop initial guidelines for designing metasurface-based variable phase shifters 123 of the type discussed herein. However, it may be necessary to further refine any final design.

Figure 9:
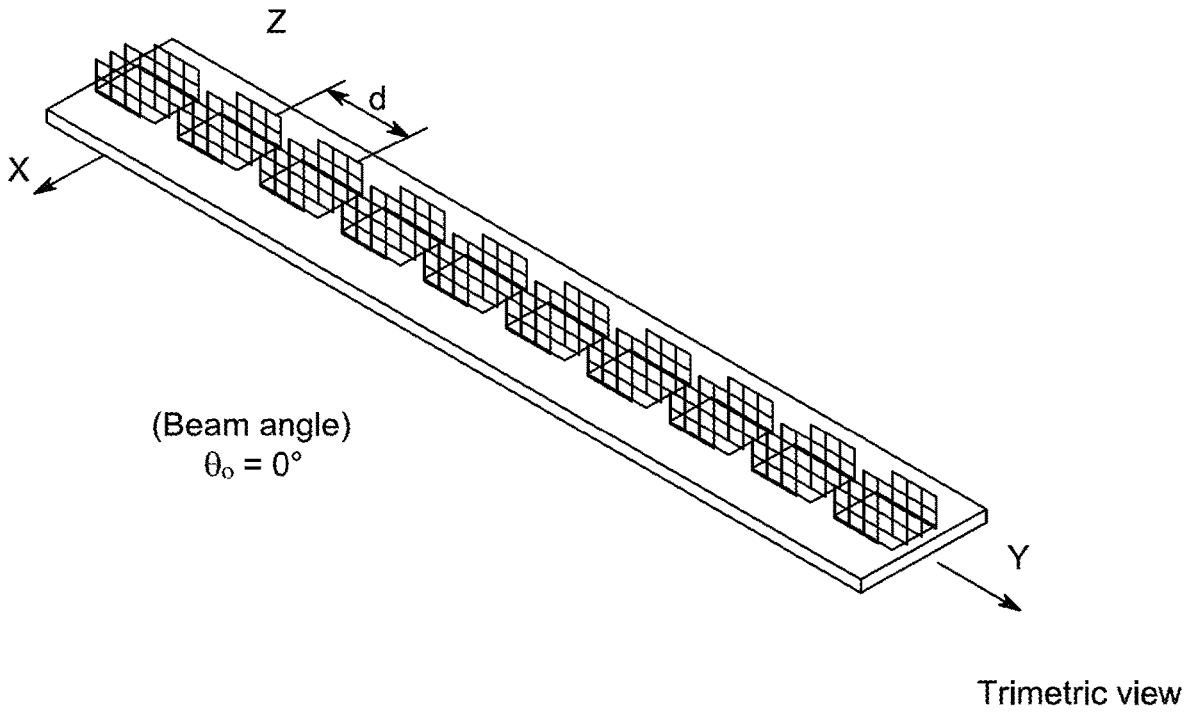
FIG. 9 is a perspective view illustrating a metasurface-based superstrate loaded linear array of 1×10 antenna elements, according to an exemplary aspect of the disclosure.

Subsequently, a variable phase shifter having a desired phase shift range from 0° to 45°, and $S_{21}$ magnitude on the order of 1.2 dB (or less) at the design frequency f=30 GHz, may be obtained by rotating the cluster angle of rotation (T) from 0° to 90°. FIG. 9 is a perspective view illustrating a metasurface-based superstrate 120 loaded linear array of 1×10 antenna elements 100, according to an exemplary aspect of the disclosure. Regarding FIG. 9, the variable phase shifter may be used for beam scanning by placing variable phase shifters 123 above each of the patch antennas 110 of the array to fine-tune the phase shifts of their radiated fields in the range of 0° to 45°, as a supplement to their step-wise phase shifts realized by inserting switchable phase shifting devices in their feed lines 113.

Using numerical simulation, it was determined that grating lobes (GLs) can be avoided in a linear array designed for beam scanning if the inter-element spacing is chosen to be less than 0.55λ. It is assumed that it is desired to design a linear array which points its main beam at $\theta_o$=45°. The progressive phase shift needed for each element to scan the beam in the desired direction, i.e., $\theta_o$=45°, can be calculated using the following equation:

$$\text{Progressive phase } (\beta) = -\frac{2\pi}{\lambda} d \sin\theta_0$$

Here 'β' is the relative phase between the elements; 'd' is the spacing between each element in terms of λ; and '$\theta_o$' is the beam-pointing direction.

The progressive phase shifts (0°, 140°, 280°, etc.) that are needed by the elements of the array in order for it to scan the beam to 45° off boresight are shown in Table 2.

TABLE 2

| Desired Phase shifts needed for the array scan angle of $\theta_o$ = 45° | | | | | | | | | | |
|---|---|---|---|---|---|---|---|---|---|---|
| Elements | 1 | 2 | 3 | 4 | 5 | 6 | 7 | 8 | 9 | 10 |
| Progressive phases at each element | 0 | 140 | 280 | 420 | 560 | 700 | 840 | 980 | 1120 | 1260 |
| Phase substracion (n*360°) | — | — | — | — | 360 | 360 | 720 | 720 | 1080 | 1080 |
| Desired Phase at each element | 0 | 140 | 280 | 60 | 200 | 340 | 120 | 260 | 40 | 180 |
| Phase using standard Phase shifter (Discrete steps: 0, 45, 90 . . . ) | 0 | 135 | 270 | 45 | 180 | 315 | 90 | 225 | 0 | 180 |
| Phase using Rotatable Phase Shifter | 0 | 5 | 10 | 15 | 20 | 25 | 30 | 35 | 40 | 0 |
| Rotation angle of Split Ring (τ) | 0 | 18 | 27 | 34 | 39 | 44 | 51 | 57 | 64 | 0 |

Beam angle: 45°;
d = 55λ;
Progressive phase shift β = −140°

Figure 10:
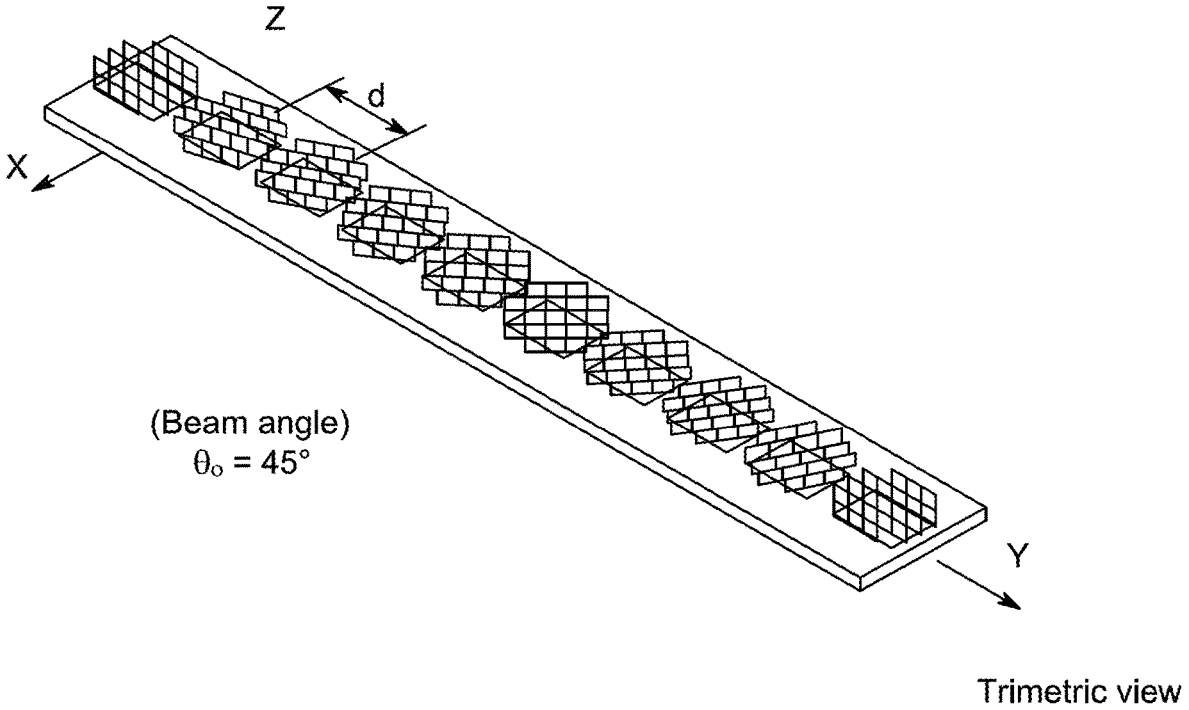
FIG. 10 is a perspective view illustrating a linear array of 1×10 antenna elements loaded with the metasurface-based superstrate 120, according to an exemplary aspect of the disclosure.

The desired phase shifts in the individual antenna elements 100 are realized in two steps as follows: (i) in the first step, one part of the phase shift is introduced in the feed lines 113 of the linear array elements (antenna elements 100) by switching them in discrete steps of 0°, 45°, 90°, etc.; (ii) next, the second part of phase shift is realized via the metasurface-based superstrate 120, by rotating the cluster at specific angles of rotation (T), in accordance with the entries provided in Table 2, which represent the total of the two constituent phase shifts. FIG. 10 is a perspective view illustrating a linear array of 1×10 antenna elements 100 loaded with the metasurface-based superstrate 120, according to an exemplary aspect of the disclosure. FIG. 10 shows the 1×10 element linear array of FIG. 9 with its elements loaded with the metasurface-based superstrate 120 variable phase shifter designed to scan the beam to $\theta_o$=45° off boresight.

Figure 11:
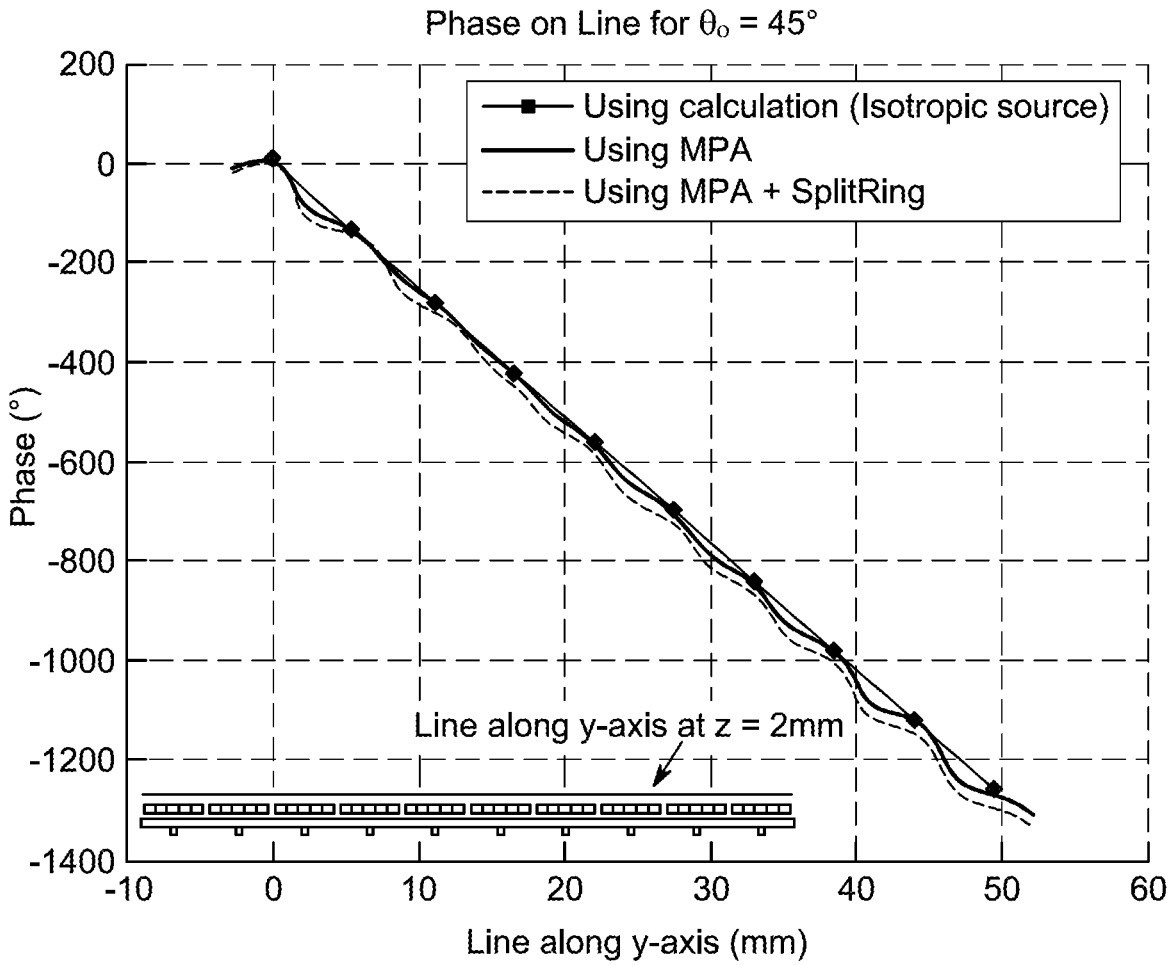
FIG. 11 is a graph illustrating a phase comparisons of 1×10 antenna element linear array for the scan angle of $\theta_o$=45°, according to an exemplary aspect of the disclosure.

To validate the results of the beam scanning design, the phase distribution of the field on a surface just above the metasurface-based superstrate 120, was checked against the calculated phase given in Table 3. FIG. 11 is a graph illustrating a phase comparisons of 1×10 antenna element linear array for the scan angle of $\theta_o$=45°, according to an exemplary aspect of the disclosure. Regarding FIG. 11, it can be seen that the realized phase values are in close agreement with the desired ones at the design frequency of 30 GHz.

TABLE 3

| Phase comparison of 1 × 10 element linear array for the scan angle of $\theta_o$ = 45° | | | | | | | | | | |
|---|---|---|---|---|---|---|---|---|---|---|
| Elements | 1 | 2 | 3 | 4 | 5 | 6 | 7 | 8 | 9 | 10 |
| Progressive phases(°) at each element (Calculated) | 0 | 140 | 280 | 420 | 560 | 700 | 840 | 980 | 1120 | 1260 |
| Progressive phases(°) at each element (Measured on top of the superstrate) | 0 | 141 | 292 | 431 | 571 | 712 | 853 | 994 | 1136 | 1277 |

Beam angle: 45°;
d = 0.55λ;
Progressive phase shift β = −140°

Figure 12:
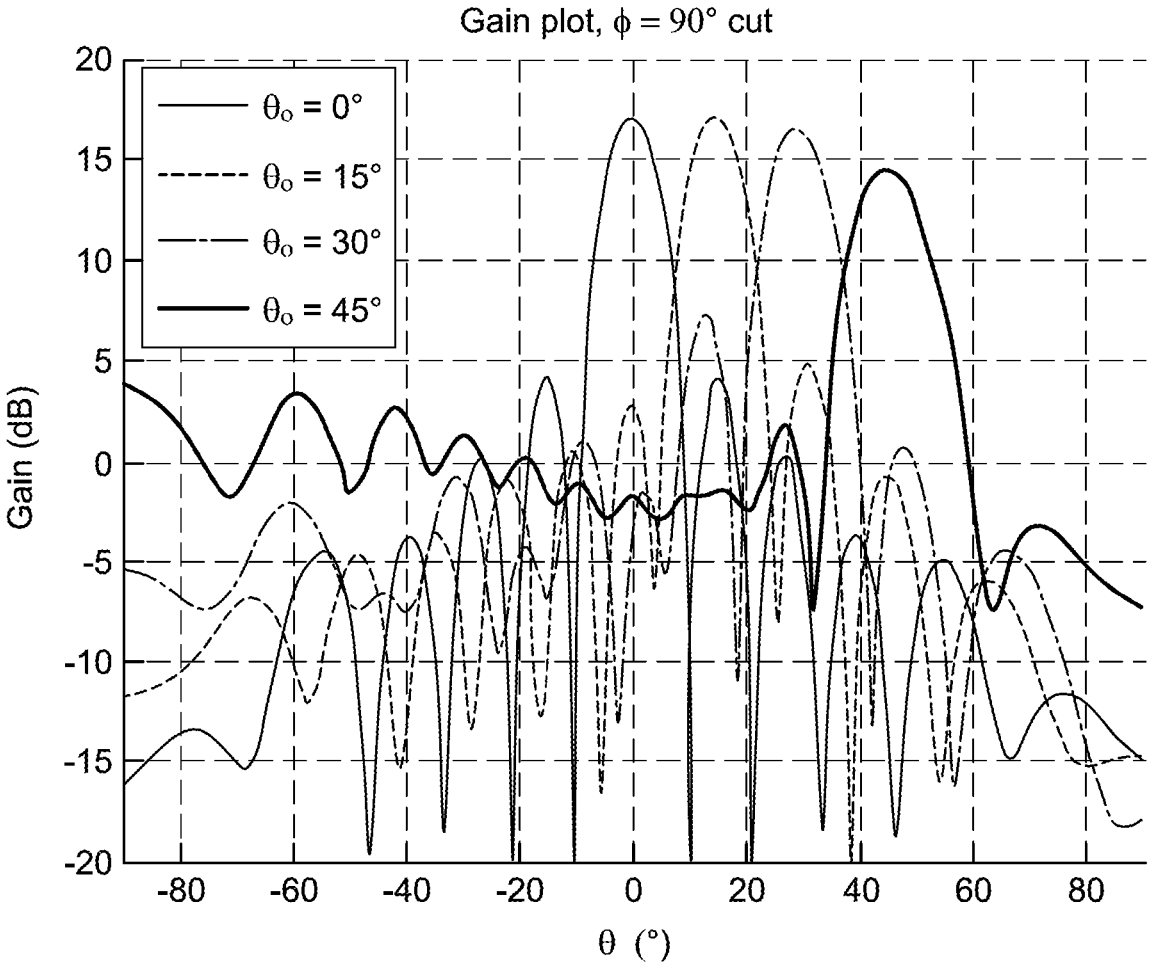
FIG. 12 is a graph illustrating gain for 1×10 antenna element linear array for different scan angles, according to an exemplary aspect of the disclosure.

FIG. 12 is a graph illustrating gain for 1×10 antenna element linear array at different scan angles, according to an exemplary aspect of the disclosure. In particular, FIG. 12 depicts the gain plots of the 1×10 array for four different beam-scanning angles, namely 0°, 15°, 30° and 45°. Additionally, Table 4 presents the gain values for different scan angles in a tabular form.

TABLE 4

| Gain values for the different beam scan angles | | |
|---|---|---|
| Sr. No. | Beam angle ($\theta_0$) | Gain (dB) |
| 1 | 0° | 16.91 |
| 2 | 14.6° | 16.89 |
| 3 | 29.1° | 16.53 |
| 4 | 44.9° | 14.9 |

FIG. 12 demonstrates that the beam can be systematically scanned from boresight to 45° by rotating the metasurface-based superstrate 120 which loads the 1×10 antenna element linear array.

Provided the above analysis results, a low-cost, variable phase shifter and the antenna elements 100 of a phased array are now described.

Obviously, numerous modifications and variations are possible in light of the above teachings. It is therefore to be understood that within the scope of the appended claims, the invention may be practiced otherwise than as specifically described herein.

For example, in the description of the exemplary embodiments, nested squares were used as a split ring structure of the variable phase shifters 123 on the metasurface-based superstrate 120. However, the variable phase shifters 123 should not be considered as being limited to this structure and any shape that is capable of providing phase shifting may be used. Likewise, the size, shape, number, and general arrangement of phase shifters 123 may be freely selected in accordance with design specifications by persons skilled in the art.

In the simulation outlined above in the experimental results, one design was described in which a first phase shift was provided to the feed line of a patch antenna 110 in increments of 45° and a second phase shift was provided through the variable phase shifters to vary from 0 to 45°. However, other phase shift values/ranges may also be used depending on design specifications. In order to obtain 360° beam angle coverage of the scanning antenna, it is preferable that the range of the second phase shift be at least equal to the distance between the discrete steps of the first phase shift.

Further, the metasurface-based superstrate 120 described in the first exemplary embodiment includes slotted strips preferably made of a foam material so as to reduce costs. However, this is merely an example of one low-cost implementation of the metasurface-based superstrate and it should be apparent to those skilled in the art that other structures or materials may be selected as long as the variable phase shifters 123 are able to adequately perform their function of shifting the field radiated by the patch antenna 110. For example, instead of slotted strips fitted together, the structure may be singularly formed from, for example, a resin, a plastic, or the like.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, defines, in part, the scope of the foregoing claim terminology such that no inventive subject matter is dedicated to the public.

REFERENCE SIGNS

100 Antenna Element
110 Patch Antenna
111 Radiating Element
113 Feed Line
120 Metasurface-Based Superstrate
121 Foam Strips
122 Slot
123 Phase Shifter
125 Precision Rotary Device
130 Switch
131 Liquid Crystal Layer

The invention claimed is:

1. A beam scanning antenna, comprising:

at least one linear array element, each linear array element having at least one patch antenna, each patch antenna including a feed line, a radiating element configured to radiate a signal from the feed line, a phase shifting device configured to provide a first phase shift in the feed line, and a precision rotary device; and at least one metasurface-based superstrate positioned above the respective patch antenna and configured to introduce a second phase shift in the signal traversing therethrough;

wherein the second phase shift varies due to rotation of the at least one metasurface-based superstrate by the precision rotary device.

2. The beam scanning antenna of claim 1, wherein the first phase shift is a stepwise increment of $\theta_x$ degrees, and the second phase shift is a range of 0 to $\theta_x$ degrees.

3. The beam scanning antenna of claim 2, wherein $\theta_x$=45 degrees.

4. The beam scanning antenna of claim 1, wherein the at least one metasurface-based superstrate is of a truncated periodic structure.

5. The beam scanning antenna of claim 1, wherein the phase shifting device is a plurality of switches.

6. The beam scanning antenna of claim 1, wherein the phase shifting device is a plurality of liquid crystal layers.

7. The beam scanning antenna of claim 1, wherein the at least one metasurface-based superstrate has a circular contour.

8. The beam scanning antenna of claim 1, wherein the precision rotary device is a stepper motor.

* * * * *